US008143869B2

(12) United States Patent
Tsai

(10) Patent No.: US 8,143,869 B2
(45) **Date of Patent: *Mar. 27, 2012**

(54) VOLTAGE REFERENCE CIRCUIT WITH FAST ENABLE AND DISABLE CAPABILITIES

(75) Inventor: Ming-Da Tsai, Miaoli County (TW)

(73) Assignee: Mediatek Inc., Science-Based Industrial Park, Hsin-Chu (TW)

( * ) Notice: Subject to any disclaimer, the term of this patent is extended or adjusted under 35 U.S.C. 154(b) by 0 days.

This patent is subject to a terminal disclaimer.

(21) Appl. No.: 12/581,154

(22) Filed: Oct. 18, 2009

(65) Prior Publication Data

US 2010/0033148 A1 Feb. 11, 2010

Related U.S. Application Data

(63) Continuation of application No. 11/561,901, filed on Nov. 21, 2006, now Pat. No. 7,626,367.

(51) Int. Cl.
*G05F 1/00* (2006.01)

(52) U.S. Cl. ..... 323/273

(58) Field of Classification Search ..... 323/268, 323/277, 282, 271, 270, 273, 272
See application file for complete search history.

(56) References Cited

U.S. PATENT DOCUMENTS 4,527,133 A 7/1985 Money
4,866,301 A 9/1989 Smith
6,407,619 B1 * 6/2002 Tanaka ..... 327/536
6,522,111 B2 2/2003 Zadeh
6,608,521 B1 8/2003 Baldwin
6,661,259 B2 * 12/2003 Tsuchi ..... 327/108
6,977,491 B1 12/2005 Caldwell
7,495,506 B1 * 2/2009 Carper ..... 327/540
2007/0252564 A1 * 11/2007 De Nisi et al. ..... 323/268

FOREIGN PATENT DOCUMENTS

CN 1821922 A 8/2006

* cited by examiner

*Primary Examiner* — Adolf Berhane
*Assistant Examiner* — Nguyen Tran
(74) *Attorney, Agent, or Firm* — Winston Hsu; Scott Margo

(57) ABSTRACT

A circuit for providing an output voltage substantially equal to a reference voltage includes: a low drop-out (LDO) regulator coupled to the reference voltage for producing the output voltage at an output terminal; a reference current source having a first end and a second end for providing a predetermined reference current; a first transistor having a first terminal coupled to a first supply voltage, a second terminal, and a control terminal coupled to the second terminal of the first transistor; a first switch for selectively coupling the second terminal of the first transistor to the first end of the reference current source according to a first control signal; and a second transistor having a first terminal coupled to the first supply voltage, a control terminal coupled to the control terminal of the first transistor, and a second terminal coupled to the output terminal.

5 Claims, 10 Drawing Sheets

VOLTAGE REFERENCE CIRCUIT WITH FAST ENABLE AND DISABLE CAPABILITIES

CROSS REFERENCE TO RELATED APPLICATIONS

This continuation application claims the benefit of co-pending U.S. patent application Ser. No. 11/561,901, filed on Nov. 21, 2006 and incorporated herein by reference.

BACKGROUND

The invention relates to voltage reference devices, and more particularly, to a voltage reference circuit with fast enable and fast disable capabilities.

Voltage reference circuits are an important element for any type of devices, including: test equipment, portable electronics, medical devices, communications systems, and others. A voltage reference circuit is used to provide a steady and reliable voltage level to any electronic circuit. Ideally, the voltage level does not alter when a load or current draw from the electronic circuit is altered. In doing this, optimal voltage conditions for the operation of the electronic circuit are reliably maintained under various conditions.

One type of voltage reference circuit used in the related art is the low drop-out (LDO) voltage regulator. FIG. 1 illustrates a schematic diagram of an LDO regulator 100 according to related art methods. The conventional LDO voltage reference circuit 100 includes an operational amplifier 102, which receives an input reference voltage ($V_{REF}$) at one input terminal, and receives a feedback voltage at the other input terminal. The operational amplifier 102 acts to amplify the difference between the values between the input terminals, outputting this result at its output terminal. The output terminal of the operational amplifier 102 is coupled to an output transistor 104. The output transistor 104 is typically power device used to supply current to the output node 108. The conventional LDO voltage reference circuit 100 also includes a resistor-capacitor network 106. The resistor-capacitor network 106 includes a load capacitor $C_L$, and resistors $R_1$ and $R_2$ connected in parallel, and is provided between output node 108 and ground potential. A feedback voltage is provided to the operational amplifier 102 from node 110 between resistors $R_1$ and $R_2$ of the resistor-capacitor network 106.

The load capacitor ($C_L$) is typically rather large (e.g., at least 1 .mu.F) in order to ensure loop stabilization. The conventional LDO voltage reference circuit 100 also receives an enable signal that is supplied to the operational amplifier 102. When the enable signal is applied, it "enables" the operational amplifier 102 of the LDO reference circuit 100, from which the output of the differential amplifier 102 activates the output transistor 104 to pull the output node 108 towards the power supply voltage ($V_{DD}$) and produce a known output reference voltage ($V_{OUT}$).

However, in some situations, a quick enabling of the reference voltage may be required. If a capacitive load is utilized, it may act to draw current from the output node 108 at a rate faster than what is initially supplied by the output transistor 104. A capacitive load may therefore initially "pull down" the desired output voltage while accumulating enough charge to reach a desired steady state. Therefore, if adequate current and voltage is not initially provided, the desired output voltage may also be reduced until a steady-state is reached.

On the other hand, when the enable signal is not applied to disable the operational amplifier 102, the output of the operational amplifier 102 deactivates the output transistor 104. In this situation, the output voltage ($V_{OUT}$) would ideally immediately drop to ground potential. However, with reference to the conventional LDO voltage reference circuit 100, the resistor-capacitor network 106 is coupled to the output node 108 and thus, the charge stored at the load capacitor ($C_L$) needs to first discharge through the resistors $R_1$ and $R_2$ before the output voltage ($V_{OUT}$) can be dropped to approach ground potential.

Because of the RC network 106 coupled to node 108, an RC time constant delay is induced that slows the decay of the output voltage ($V_{OUT}$) while approaching ground potential. Additionally, because of the typically large capacitance of the load capacitor ($C_L$), and the large resistances of the resistors $R_1$ and $R_2$ (e.g., usually 10 k ohms or more), a large RC time constant results to cause a slow response of output voltage ($V_{OUT}$) decay in the disable situation. Therefore, while large load capacitors are used by conventional voltage reference circuits to ensure loop stabilization, they inadvertently hinder a rapid disabling of conventional voltage reference circuits.

Failure or delay in providing rapid disabling can lead to undesirable effects. For example, suppose a voltage reference circuit is required to provide a precise voltage reference to an electrical system, such as a portable computing device. In this application, when the voltage reference circuit is disabled, it is supposed to immediately remove power to the portable computing device. However, the slow responsiveness of the output voltage ($V_{OUT}$) when disabling the voltage reference circuit, causes the portable computing device to undesirably consume power during the time it takes for the voltage reference circuit to become fully disabled (i.e., $V_{OUT}=0$). Accordingly, this leads to poor power management for the electrical system because the portable computing device will continue to draw power from the power source (e.g., a battery) until the voltage reference becomes fully disabled.

Additionally, it is desirable to ensure the LDO regulator 100 possesses a good power supply ripple rejection ratio (PSRR), which is a measure of how well a circuit rejects ripple coming from the input at various frequencies. A high PSRR is generally desirable; however, it makes loop stability more difficult and limits control of the gain-bandwidth product to control PSRR. Altering the PSRR, therefore, may involve moving of the dominant poles in the device transfer function, which in turn affects bandwidth and noise characteristics. As noise characteristics of the LDO regulator 100 tend to increase with higher PSRR, a suitable tradeoff must therefore be established to meet overall design goals of the LDO regulator.

Therefore, there is a need for voltage reference circuits that not only remain stable, but also can rapidly switch to and from enabled states and disabled states, while providing low noise output and a high PSRR.

SUMMARY

One objective of the claimed invention is therefore to provide an integrated circuit that provides an output voltage substantially equal to a reference circuit, while having fast turn-on and fast turn-off capabilities to solve the above-mentioned problem.

According to an embodiment of the present invention, a circuit for providing an output voltage substantially equal to a reference voltage is provided. The circuit comprises a low drop-out (LDO) regulator, a reference current source, a first transistor, a first switch, and a second transistor. The low drop-out (LDO) regulator is coupled to the reference voltage for producing the output voltage at an output terminal. The reference current source has a first end and a second end for providing a predetermined reference current. The first transistor has a first terminal coupled to a first supply voltage, a second terminal, and a control terminal coupled to the second terminal of the first transistor. The first switch selectively couples the second terminal of the first transistor to the first end of the reference current source according to a first control signal. The second transistor has a first terminal coupled to the first supply voltage, and a control terminal coupled to the control terminal of the first transistor, and a second terminal coupled to the output terminal.

According to a second embodiment of the present invention, a circuit for providing an output voltage substantially equal to a reference voltage is provided. The circuit includes a low drop-out (LDO) regulator, a first current providing circuit, and a second current providing circuit. The low drop-out (LDO) regulator is coupled to the reference voltage for producing the output voltage at an output terminal. The first current providing circuit is coupled between a first supply voltage and a second supply voltage for selectively providing a predetermined reference current according to a first control signal. The second current providing circuit is coupled between the first supply voltage and the second supply voltage for generating an output current at the output terminal according to the predetermined reference current.

According to a third embodiment of the present invention, a circuit for providing an output voltage substantially equal to a reference voltage is provided. The circuit includes a low drop-out (LDO) regulator, a reference current source, a current mirror, and a first switch. The low drop-out (LDO) regulator is coupled to the reference voltage for producing the output voltage at an output terminal. The reference current source has a first end and a second end for providing a predetermined reference current. The current mirror is coupled to a first supply voltage. The first switch selectively couples the first end of the reference current source to the current mirror according to a first control signal, wherein the current mirror mirrors the predetermined reference current to generate an output current at the output terminal when the first control signal controls the first switch to couple the first end of the reference current source to the current mirror.

These and other objectives of the present invention will no doubt become obvious to those of ordinary skill in the art after reading the following detailed description of the preferred embodiment that is illustrated in the various figures and drawings.

DETAILED DESCRIPTION

The invention relates to a voltage reference circuit with the ability to quickly reach an enabled state to provide adequate current and voltage to a connected load device. The voltage reference circuit can also quickly reach a disabled state to prevent unnecessary power from being consumed after a desired power down interval. Low noise output and high PSRR is also achieved through design goals of the invention. The voltage reference circuit can be an integrated voltage reference circuit, or a voltage regulator. In one embodiment, the voltage reference circuit comprises a low drop-out voltage device.

When applied to portable electronic equipment, the invention is particularly useful as it allows for an immediate disabling of the driving voltage for more efficient energy management for devices utilizing the fast turn-off circuit. Alternatively, the fast turn-on circuit allows for immediate power to be provided to the devices as well. This will help ensure that optimal steady state voltage conditions are realized as quickly as possible, to immediately provide optimal conditions for device performance. The fast turn-on circuit additionally incorporates a third control signal, contrary to the related art, in order to modulate an output current of the voltage reference circuit output. Modulation (or intermittent stoppage) of the output current will help decrease voltage overshoot effects at the voltage reference circuit output. Additionally, noise and PSRR characteristics of the invention can be controlled, in order to provide a low noise, limited bandwidth voltage regulating abilities, while maintaining a good PSRR.

Prior to a concise detailing of the invention, it is important to note that certain terms are used throughout the following description and claims to refer to particular system components. As one skilled in the art will appreciate, manufacturers may refer to a component by different names. This document does not intend to distinguish between components that differ in name but not function. In the following discussion and in the claims, the terms "including" and "comprising" are used in an open-ended fashion, and thus should be interpreted to mean "including, but not limited to . . . " The terms "couple" and "couples" are intended to mean either an indirect or a direct electrical connection. Thus, if a first device couples to a second device, that connection may be through a direct electrical connection, or through an indirect electrical connection via other devices and connections.

Figure 2:
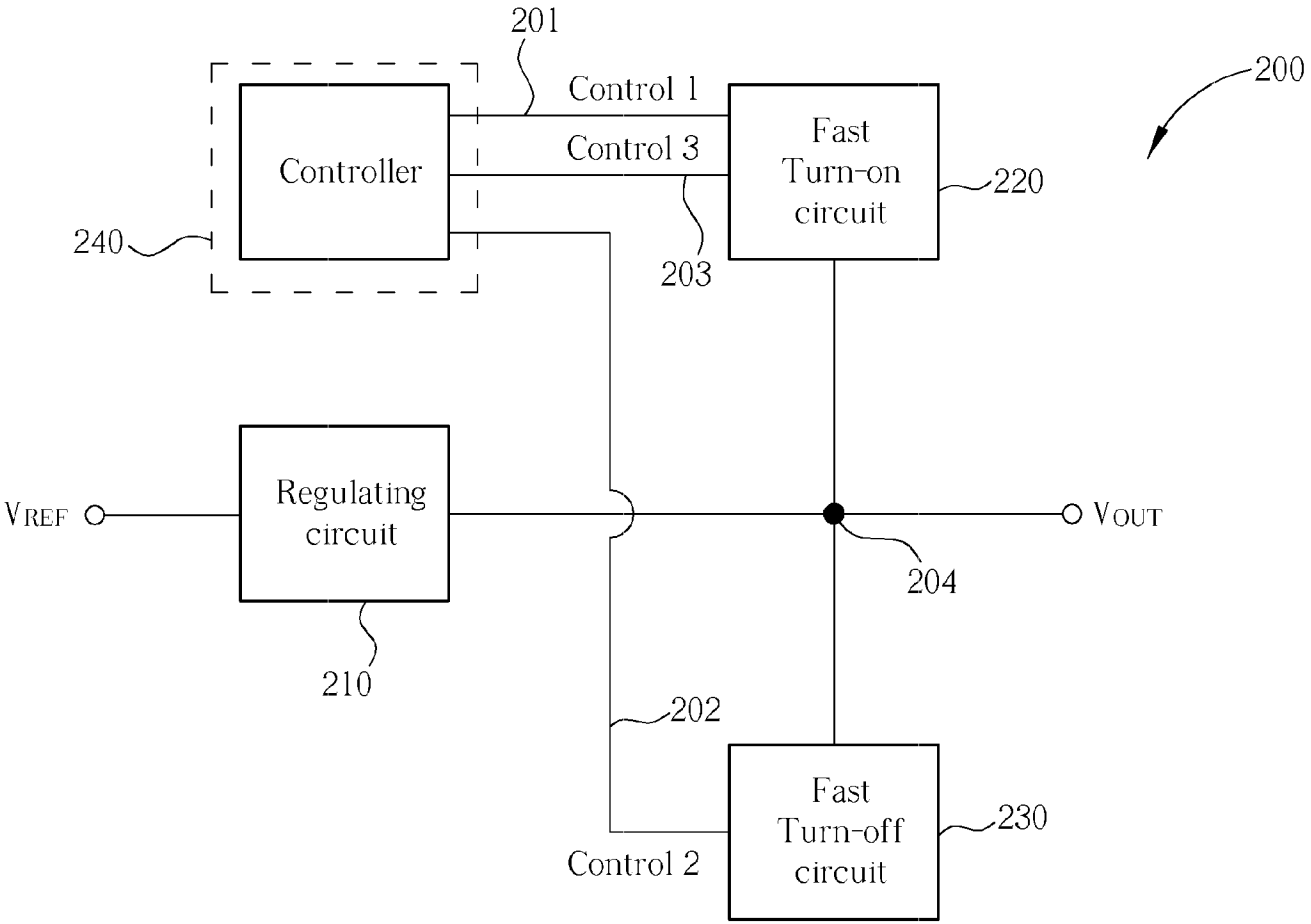
FIG. 2 illustrates a first embodiment an integrated circuit providing an output voltage substantially equal to a reference voltage according to the invention.

FIG. 2 illustrates a first embodiment of the integrated circuit for providing an output voltage substantially equal to a reference voltage, according to the invention. The circuit 200 comprises a regulating circuit 210 receiving an input reference voltage $V_{REF}$, and outputting an output voltage $V_{OUT}$ at an output terminal 204. A fast turn-on circuit 220 is coupled to the output terminal 204 and is utilized to quickly provide an output voltage to the output terminal 204 according to a first control signal 201. A fast turn-off circuit 230 is also coupled to the regulating circuit 210 through the output terminal 204, and is utilized to quickly draw a discharge current from the output terminal 204 according to a second control signal 202.

It should be noted that in some cases, according to different design purposes, it is possible to utilize only one of the fast turn-on circuit 220 or the fast turn-off circuit 230 of the present invention. This will be discussed later, however, in more detail.

Figure 1:
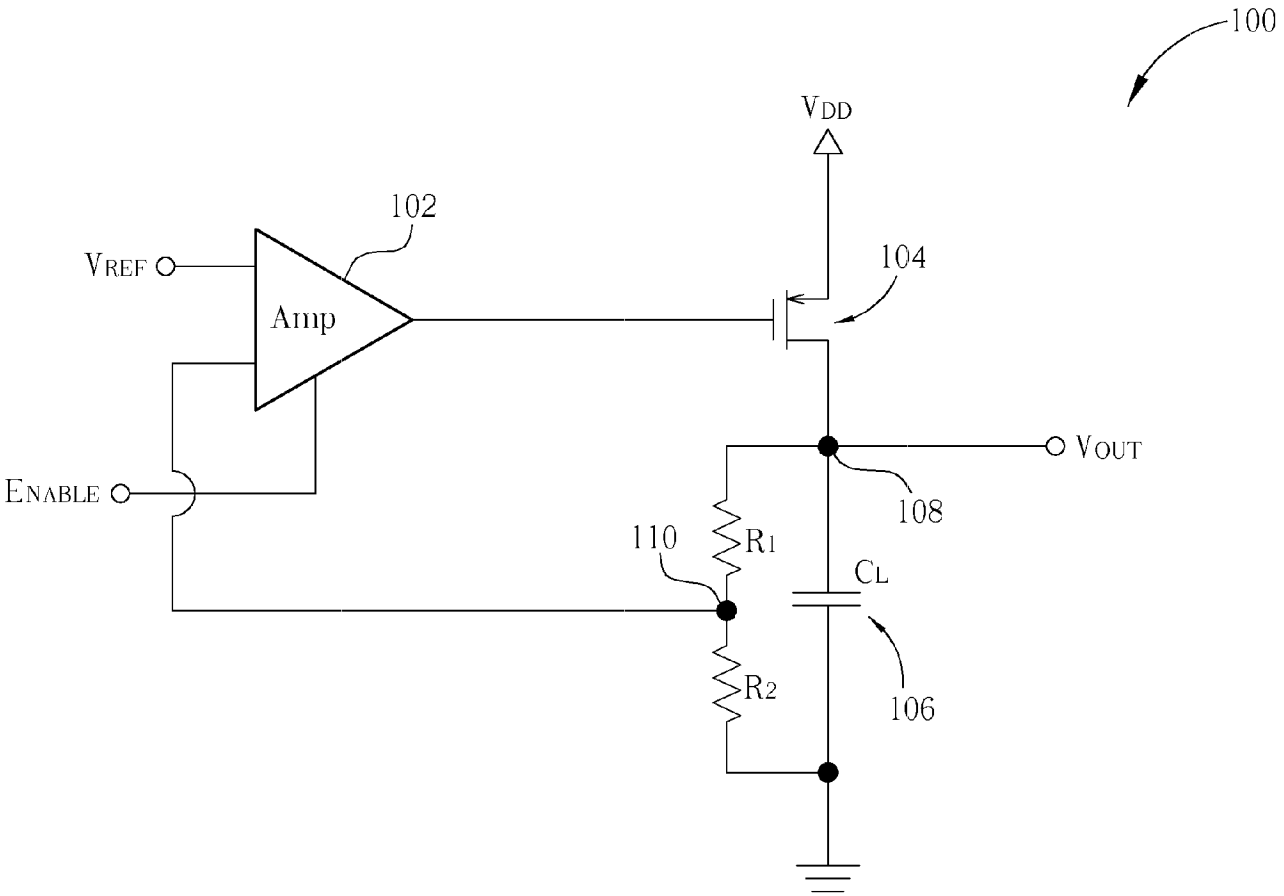
FIG. 1 RELATED ART
FIG. 1 illustrates an LDO regulator according to the related art.

Operation of the circuit 200 is now detailed. A reference voltage $V_{REF}$ is provided to the regulating circuit 210 from an alternate source, which indicates a desired voltage level for the output voltage $V_{OUT}$ to maintain. The regulating circuit 210, therefore, manages to provide an output voltage $V_{OUT}$ substantially similar to or proportional to the reference voltage $V_{REF}$. The regulating circuit 210 can be, in certain embodiments, a voltage regulator, such as a low drop-out (LDO) regulator similar to that described in FIG. 1. As general voltage regulators are well known to those skilled in the related art, a concise description is omitted for brevity. However, a particular embodiment of the regulating circuit 210 will be additionally discussed later on, and is particularly useful when applied to the circuit 200 for attaining low noise and high PSRR of the regulating circuit 210.

When operation of the circuit 200 is desired, a first control signal 201 is asserted, which enables the fast turn-on circuit 220. The fast turn on circuit 220 acts to quickly supply an output current to the output terminal 204 to ensure that the desired output voltage $V_{OUT}$ is reached in spite of the arbitrary load device, which may be applied to the output terminal 204. In this manner, the load device applied to the output terminal 204 can instantaneously achieve a desired operational voltage for immediate without loss of time or reduced efficiency.

Conversely, when the circuit 200 is intended to be shut off, a second control signal 202 is applied to the fast turn-off circuit 230. The fast turn-off circuit 230, in turn, acts to draw a discharge current from the output terminal 204 to immediately prevent any further current from being applied to the arbitrary load device. As described in the related art, in many cases, the regulating circuit 210 may contain a capacitive element incorporated at its output. Also, the arbitrary load coupled to the output terminal 204 may also have a capacitive charge-storing element. In these situations, the fast turn-off circuit 230 would immediately draw current from the output terminal 204 to effectively drain stored current/charge present at the output terminal 204. In this manner, the supply of output current is immediately drawn from the output terminal 204 to prevent unnecessary power draw from the regulating circuit 210 by a load device. Optimal power efficiency is then achieved as the arbitrary load device is prohibited from operation beyond an intended shutoff time of the circuit 200.

In additional embodiments of the circuit 200, a third control signal 203 may be utilized to provide an additional element of control for the fast turn-on circuit 220. As described above, after the first control signal 201 has been applied, the fast turn-on circuit 220 provides an output current to the output terminal 204. However, an overshoot condition may occur, wherein the output voltage $V_{OUT}$ surpasses the desired voltage level $V_{REF}$, until feedback elements intrinsic to the regulating circuit 210 realize this condition and make proper adjustments to maintain the output voltage $V_{OUT}$ near or proportional to the reference voltage $V_{REF}$. The third control signal 203, therefore acts to modulate, or stop, the supply of output current to output terminal 204 in order to prevent an overshoot condition. It should be noted that in some cases, the third control signal 203 may be a control signal extracted from the regulating circuit 210, or LDO.

As known to those skilled in the related art, an overshoot of driving voltage $V_{OUT}$ for a load device may inadvertently damage the load device, as the recommended operating voltage may be surpassed. Internal elements of the load device may therefore exceed a maximum current/voltage limit, causing meltdown, excess heat, and or static charge damage to its internal components. Additionally, energy may be wasted as current exceeding that required for operation by the load device may be temporarily supplied. Moreover, an overshoot of output voltage $V_{OUT}$ may also inadvertently create delays of the fast turn on circuit, since the desired output voltage $V_{OUT}$ is artificially increased and will requires more time to reach the inflated steady state output voltage. Preventing an overshoot of output voltage $V_{OUT}$ will therefore prevent excessive power to be supplied to a load device, and also help prevent damage to the load device when coupled to output terminal 204.

In another embodiment of the invention circuit 200, a controller 240 is included for providing the first control signal 201, the second control signal 202, and possibly the third control signal 203. The controller 240 can be integrated with the regulating circuit 210 and/or coordinated in such a way such that operation detailed above occurs synchronously to immediately enable the fast turn-on circuit 220 when power-on for a load device is required. Also, the controller 240 will apply the third control signal 203 accordingly to prevent an overshoot condition, and apply the second control signal 202 to immediately cease operation of circuit 200. The controller 240 can be implemented through a logic array, a series of logic control devices, a microprocessor, or any relevant control element. The precise implementation of the controller 240 is intermediate, and can exist in many variations, so long as it suffices in providing proper coordination and application of the first control signal 201, the second control signal 202, and third control signal 203 for operation of circuit 200.

Figure 3:
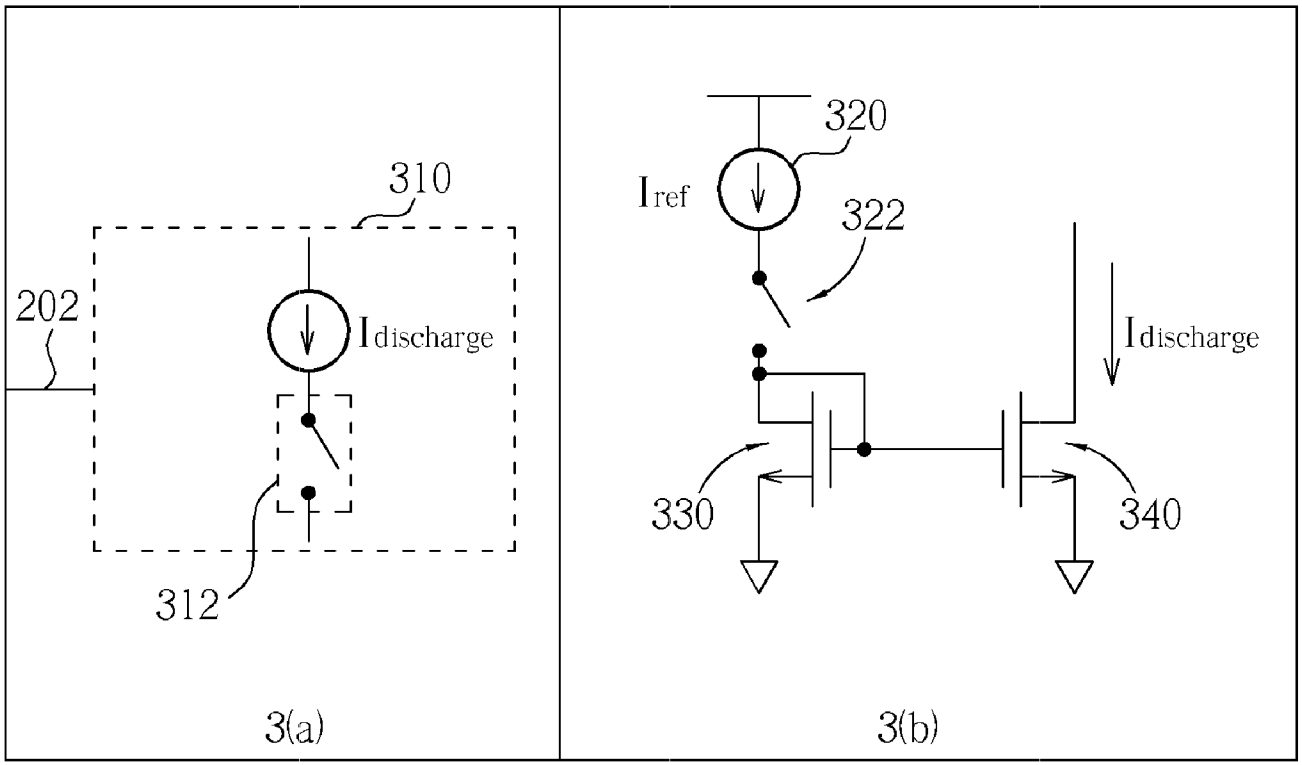
FIG. 3 illustrates an embodiment of the fast turn-off circuit of FIG. 2.

FIG. 3 illustrates an embodiment for possible implementation of the fast turn-off circuit 230 of FIG. 2. In FIG. 3*a*, the fast turn-off circuit 230 comprises a discharge current source 310 for drawing the discharge current $I_{discharge}$ from the output terminal 204 according to the second control signal 202. The second control signal 202, in certain embodiments, may be coupled to a switch 312 to enable operation of the discharge current source 310 for operation as detailed above.

FIG. 3*b* illustrates another embodiment also implementing the discharge current source 310 of FIG. 3*a*. In this embodiment, the discharge current source 310 comprises: a reference current source 320 for providing a predetermined reference current $I_{ref}$, a switch 322 having a first end coupled to the reference current source 320 for selectively coupling the predetermined reference current $I_{ref}$ to a second end of the switch according to the second control signal 202. A first transistor 330 having a first terminal coupled to the second end of the switch 322 is included, which has its control terminal coupled to the first terminal of the first transistor 330, and a second terminal coupled to a supply voltage. A second transistor 340 having a first terminal coupled to the output terminal 204, a control terminal coupled to the control terminal of the first transistor, and a second terminal coupled the supply voltage completes the discharge current source of this embodiment. In this embodiment, transistors 330 and 340 essentially form a current mirror, where transistor 340 acts to draw a discharge current $I_{discharge}$ substantially equal to the predetermined reference current $I_{ref}$. The current mirror begins operation when the second control signal 202 is applied to enable switch 322 to complete the circuit.

Figure 4:
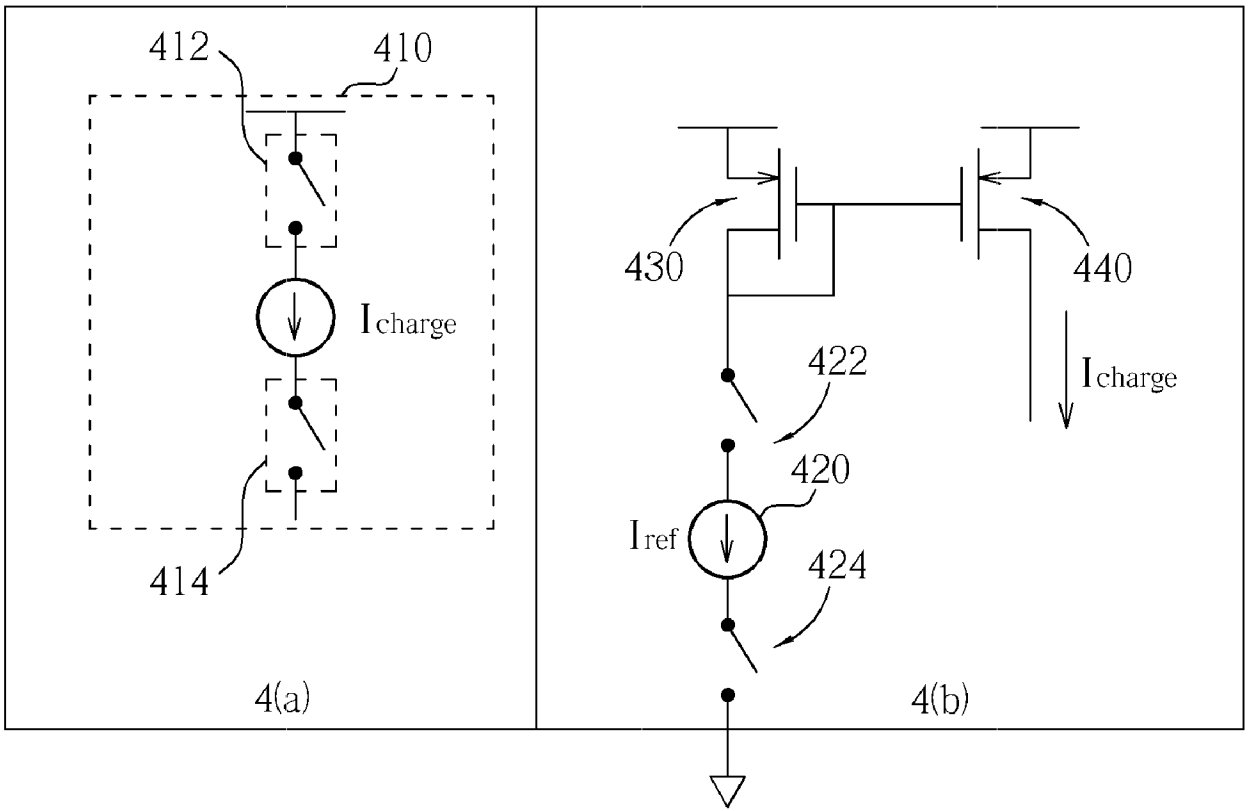
FIG. 4 illustrates an embodiment of the fast turn-on circuit of FIG. 2.

FIG. 4 illustrates an embodiment for possible implementation of the fast turn-on circuit 220 of FIG. 2. In FIG. 4*a*, the fast turn-on circuit 220 comprises a charge current source 410 for supplying an output current $I_{charge}$ to the output terminal 204 according to the first control signal 201. The first control signal 201, in certain embodiments, may be coupled to a switch 412 to enable operation of the charge current source 410 for operation as detailed above. The third control signal 203, also in certain embodiments, may be coupled to a second switch 414 for modulation of the charge current source 410 also described above.

FIG. 4*b* illustrates another embodiment also implementing the charge current source 410 of FIG. 4*a*. In this embodiment, the charge current source 410 comprises: a reference current source 420 having a first end and a second end, for providing a predetermined reference current $I_{ref}$, a first transistor 430 having a first terminal coupled to a first supply voltage, and a second terminal coupled to a control terminal of the first transistor 430. A first switch 422 is included for selectively coupling the second terminal of the first transistor 430 to the first end of the reference current source 420 according to the first control signal 201. A second switch 424 is included for selectively coupling the second end of the reference current source 420 to a second supply voltage according to the third control signal 203. Finally, a second transistor 440 is included having a first terminal coupled to the first supply voltage, a control terminal coupled to the control terminal of the first transistor 430, and a second terminal coupled the output voltage $V_{OUT}$ at the output terminal 204. In this embodiment, transistors 430, 440 essentially form a current mirror, where transistor 440 acts to supply a charge current $I_{charge}$ substantially equal to the predetermined reference current $I_{ref}$. The current mirror begins operation when the first control signal 201 is applied to enable switch 422 to complete the current mirror circuit. A third control signal 203 is used to operate switch 424, which acts to modulate (or stop) the reference current $I_{ref}$, and in turn, modulate (or stop) the charge current $I_{charge}$ to prevent an overshoot condition at the output terminal 204.

Figure 5:
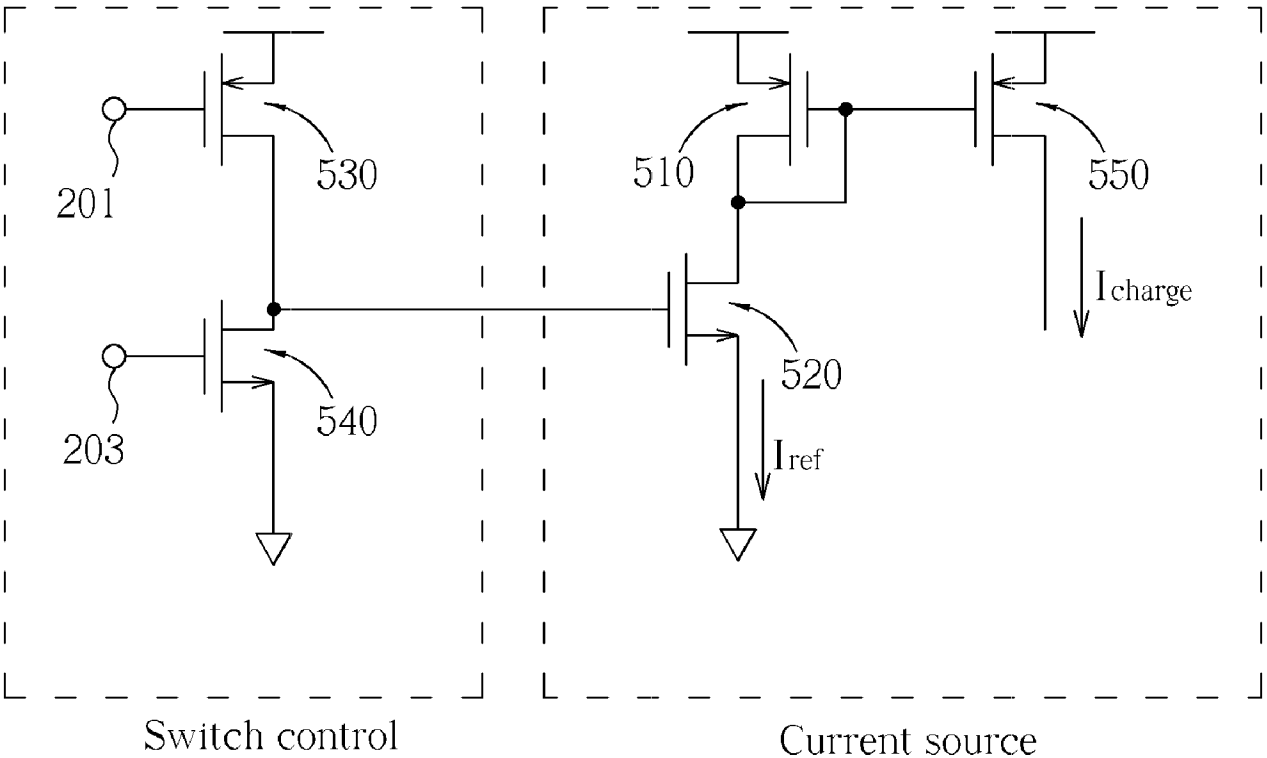
FIG. 5 illustrates an embodiment for implementing the charge current source of FIG. 4*a*.

FIG. 5 illustrates an additional embodiment for implementing the charge current source 410 of FIG. 4*a* according to the invention. In this embodiment, the charge current source 410 can be thought of as divided into two main components: the switch control component (on the left) and the current source component (on the right). The current source component of the charge current source 410 comprises: a first transistor 510 with the first terminal coupled to a first supply voltage, and the second terminal coupled to a control terminal of the first transistor 510. A second transistor 520 includes a control terminal for the second transistor 520, a first terminal of the second transistor 520 coupled to the second terminal of the first transistor 510, and a second terminal of the second transistor 520 coupled to a second supply voltage. Finally, a fifth transistor 550 completes the current source, which has a first terminal of the fifth transistor 550 coupled to the first supply voltage, a control terminal of the fifth transistor 550 coupled to the control terminal of the first transistor 510, and a second terminal of the fifth transistor 550 coupled to the output terminal 204. Operation of the current source component of the charge current source 410 in this embodiment behaves similar to the current mirror illustrated in FIG. 4*b*, with the reference current $I_{ref}$ being provided through the second transistor 520. The charge current $I_{charge}$, therefore acts to mirror the reference current $I_{ref}$ to quickly supply current to the output terminal 204 of circuit 200.

Control of the current source component in this embodiment is provided by the switch control component (left of FIG. 5). The switch control component of FIG. 5 includes: a third transistor 530 having a first terminal coupled to the first supply voltage, a control terminal of coupled to the first control signal 201, and a second terminal coupled to the control terminal of the second transistor 520. Also, a fourth transistor 540 is included having a first terminal coupled to the second terminal of the third transistor 530, a control terminal coupled to the third control signal 203, and a second terminal coupled to the second supply voltage. It should be noted that FIG. 5 only shows a single embodiment, and is not meant to be a limitation to the invention. In some embodiment of the present invention, the first control signal 201 and the third control signal 203 can be further integrated through a digital circuit (not shown) controlled by a single control signal. In this embodiment, the first control signal 201 acts to enable the third transistor 530, which in turn enables the second transistor 520 to produce the reference current $I_{ref}$. This causes the current mirror to react in producing the charge current $I_{charge}$ to quickly provide current to the output terminal 204. Additionally, the third control signal 203 is utilized through the fourth transistor 540 to modulate (or stop) the reference current $I_{ref}$, which in turn modulates (stop) the charge current $I_{charge}$ in preventing an overshoot condition. For example, in some embodiments, after a period of current charging time, when the voltage of the output terminal 204 reaches (or approaches) a desired output voltage, the third control signal 203 is utilized through the fourth transistor 540 to stop the reference current $I_{ref}$, which in turn stops the charge current $I_{charge}$ from charging the voltage of the output terminal 204.

An undesirable quiescent current, which flows through transistors 530 and 540, will be induced if transistors 530 and 540 are both turn enabled. Unfortunately, in this embodiment, when the charge current source 410 is in steady state, transistors 530 and 540 remain turned on under the above control of the first and third control signals 201 and 203. In order to eliminate the quiescent current and reduce power consumption, the first control signal 201 is applied to further disable the third transistor 530 when the charge current source 410 in FIG. 5 enters into steady state.

Figure 6:
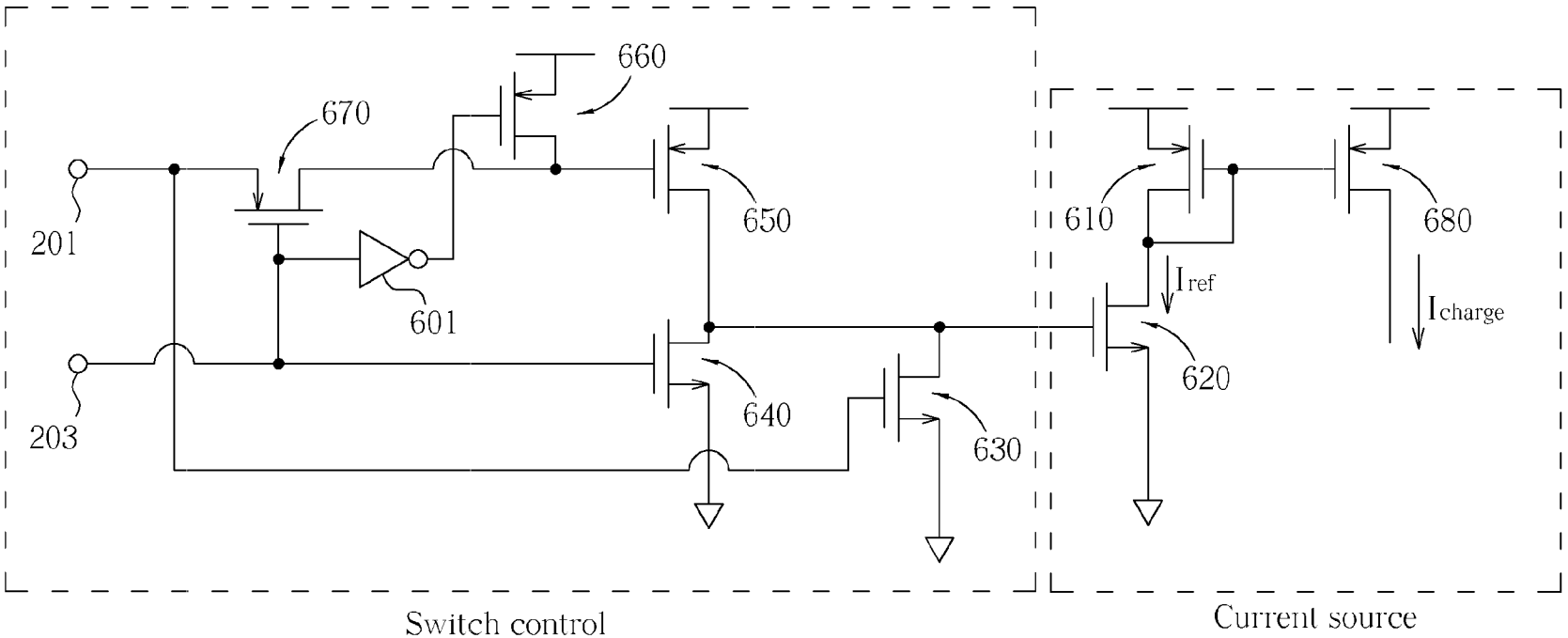
FIG. 6 illustrates an additional embodiment for implementing the charge current source of FIG. 4*a*.

FIG. 6 illustrates another embodiment for implementing the charge current source 410 of FIG. 4*a* according to the invention. In this embodiment, the charge current source 410 can also be thought of as separated into two main components: the switch control component (on the left) and the current source component (on the right). In this embodiment, the architecture and operation of the current source component in this embodiment is similar to the current source component in FIG. 5. Hence a detailed description of the current source component in this embodiment is omitted for the sake of brevity. A detailed description of the switch control component in this embodiment is provided in the following.

Control of the current source component in this embodiment is provided by the switch control component (left of FIG. 6). The switch control component of FIG. 6 includes: a third transistor 630 having a first terminal coupled to the control terminal of the second transistor 620, a second terminal coupled to the second supply voltage, and a control terminal coupled to the first control signal 201. Also, a fourth transistor 640 is used having a first terminal coupled to the control terminal of the second transistor 620, a second terminal coupled to the second supply voltage, and a control terminal of the fourth transistor 640 coupled to the third control signal 203. Also, a fifth transistor 650 is used having a control terminal, a first terminal coupled to the first supply voltage, and a second terminal coupled to the control terminal of the second transistor 620. A sixth transistor 660 is used, which has a control terminal, a first terminal coupled to the first supply voltage, and a second terminal coupled to the control terminal of the fifth transistor 550. An inverter 601 for inverting an input signal is included, having an input end of the inverter 601 coupled to the third control signal 203, and an output end of the inverter 601 coupled to the control terminal of the sixth transistor 660. Finally, a seventh transistor 670 completes the switch control component of FIG. 6. The seventh transistor 670 has a first terminal coupled to a control terminal of the fifth transistor 650, a second terminal coupled to the first control signal, and a control terminal coupled to the third control signal 203. Again, the switch control component in FIG. 6 acts to provide control for the current source component in the charge current source 410. A detailed description of the switch control component is provided in the following.

In this embodiment, the first control signal 201 and second control signal 202 act to enable various transistors (as shown), which in turn enables the second transistor 620 to produce the reference current $I_{ref}$. This causes the current mirror (the current source component) to react in producing the charge current $I_{charge}$ to quickly provide current to the output terminal 204. Additionally, the third control signal 203 is also utilized to modulate (or stop) the reference current $I_{ref}$, which in turn modulates (or stop) the charge current $I_{charge}$ in preventing an overshoot condition.

Moreover, the switch control component in this embodiment also provides the benefit of preventing the quiescent current effect without adding extra control elements. As described in the previous embodiment (in FIG. 5), the quiescent current is induced when the transistors in the same path are all turned on. Fortunately due to this layout, there is no opportunity for such a path in this embodiment. Before the charge current source 410 in FIG. 6 reaches the steady state, the transistor 650 is already turned off under the operation of inverter 601 and transistor 660 controlled by the third control signal 203. In other words, different from previous embodiments, the charge current source 410 in this embodiment has no quiescent current in its circuit and hence does not waste extra power without additional control elements.

Therefore, through the above description, the invention provides an integrated circuit that provides an output voltage substantially equal to a reference voltage while possessing fast turn-on and fast turn-off capabilities. The voltage reference circuit described above not only remains stable under steady state conditions, but also rapidly switches to an enabled state to provide a proper output voltage, while rapidly switching to a disabled state in a power off setting.

Although the above embodiments have discussed the voltage reference circuit involving both fast turn on, and fast turn of capabilities, other embodiments may not require both capabilities, and hence may only use one according to requirements of a user.

Figure 7:
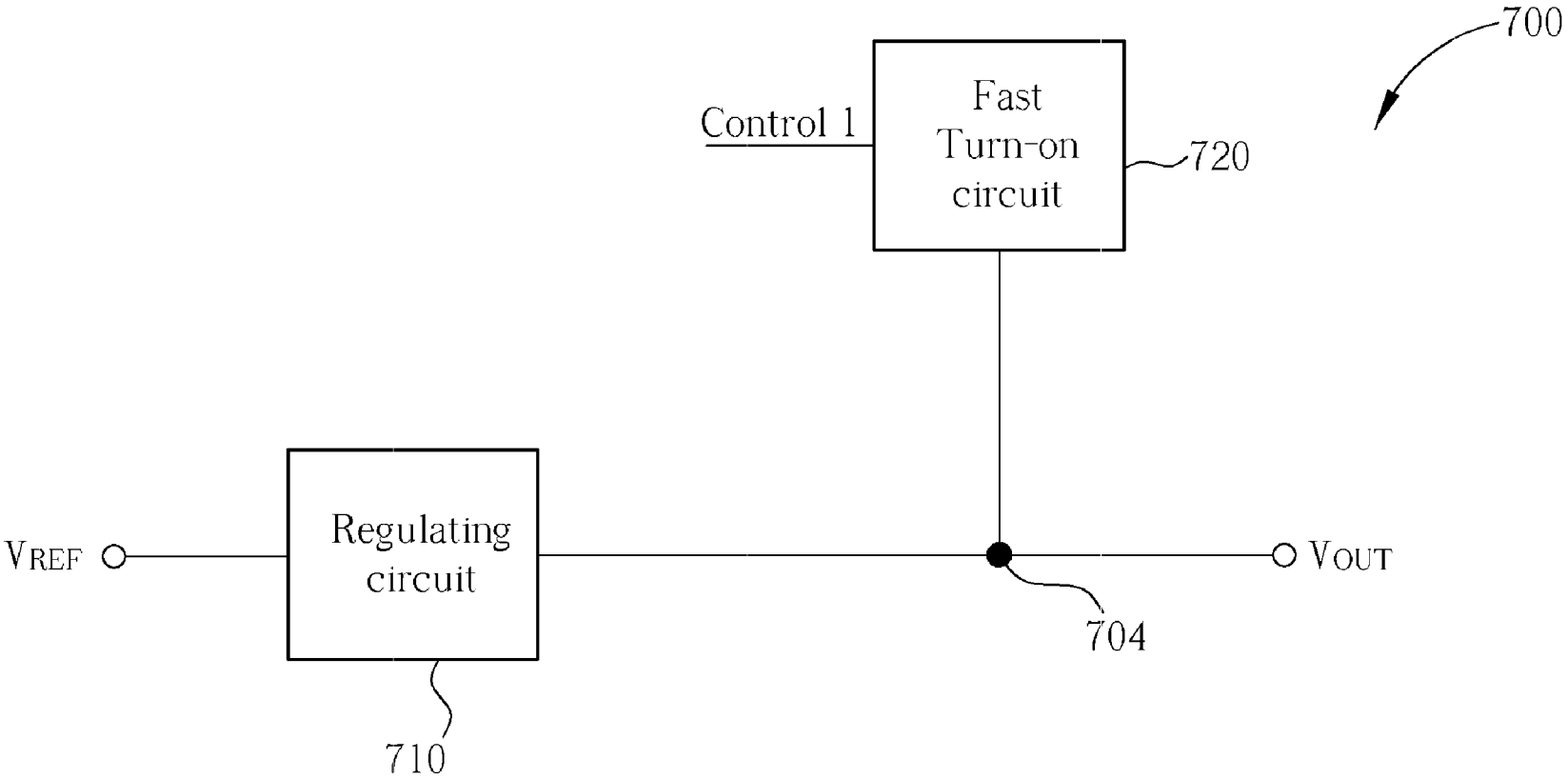
FIG. 7 illustrates an embodiment of an integrated circuit with fast turn on capabilities for providing an output voltage substantially equal to a reference voltage, according to the invention.

FIG. 7 illustrates an embodiment of an integrated circuit 700 having fast turn-on capabilities, for providing an output voltage substantially equal to a reference voltage, according to the invention. The circuit 700 comprises a regulating circuit 710 receiving an input reference voltage $V_{REF}$, and outputting an output voltage $V_{OUT}$ at an output terminal 704. A fast turn-on circuit 720 is coupled to the output terminal 704 and is utilized to quickly provide an output voltage to the output terminal 704 according to a first control signal (Control 1).

Operation of circuit 700 is now discussed. A reference voltage $V_{REF}$ is provided to the regulating circuit 710 from an external source, which indicates a desired voltage level for the output voltage $V_{OUT}$ to maintain. The regulating circuit 710 manages to provide an output voltage $V_{OUT}$ substantially similar to or proportional to the reference voltage $V_{REF}$. Similar to the above embodiments, the regulating circuit 710 can be a voltage regulator (such as a low drop-out (LDO) regulator similar to that described in FIG. 1). As voltage regulators are well known to those skilled in the related art, a concise description is omitted for brevity.

When operation of the circuit 700 is desired, a first control signal is asserted, which enables the fast turn-on circuit 720. The fast turn on circuit 720 acts to quickly supply an output current to the output terminal 704 to ensure that the desired output voltage $V_{OUT}$ is reached in spite of the arbitrary load device, which may be applied to the output terminal 704. In this manner, the load device applied to the output terminal 704 can instantaneously achieve a desired operational voltage for immediate without loss of time or reduced efficiency.

As with the previously discussed fast turn on circuit 220 of FIG. 2, the fast turn on circuit 720 of FIG. 7 can also comprise the same embodiments as shown in FIGS. 4, 5 and 6, with similar composition and functionality. Therefore, further discussion is omitted for brevity.

In additional embodiments of the circuit 700, a third control signal (not shown) may be utilized to provide an additional element of control for the fast turn-on circuit 720. As described above, after the first control signal has been applied, the fast turn-on circuit 720 provides an output current to the output terminal 704. However, an overshoot condition may occur, wherein the output voltage $V_{OUT}$ surpasses the desired voltage level $V_{REF}$, until feedback elements intrinsic to the regulating circuit 710 realize this condition and make proper adjustments to maintain the output voltage $V_{OUT}$ near or proportional to the reference voltage $V_{REF}$. The third control signal, therefore acts to modulate, or stop, the supply of output current to output terminal 204 in order to prevent an overshoot condition. It should be noted that in some cases, the third control signal may be a control signal extracted from the regulating circuit 710, or LDO.

As known to those skilled in the related art, an overshoot of driving voltage $V_{OUT}$ for a load device may inadvertently damage the load device, as the recommended operating voltage may be surpassed. Internal elements of the load device may therefore exceed a maximum current/voltage limit, causing meltdown, excess heat, and or static charge damage to its internal components. Additionally, energy may be wasted as current exceeding that required for operation by the load device may be temporarily supplied. Moreover, the overshoot of output voltage $V_{OUT}$ may also cause the fast turn on circuit to lose its advantage of "fast" turn on since the output voltage $V_{OUT}$ is not desired due to the overshoot and hence it takes more time to reach the desired output voltage $V_{OUT}$. Preventing an overshoot of output voltage $V_{OUT}$ will therefore prevent excessive power to be supplied to a load device, and also help prevent damage to the load device when coupled to output terminal 704.

Figure 8:
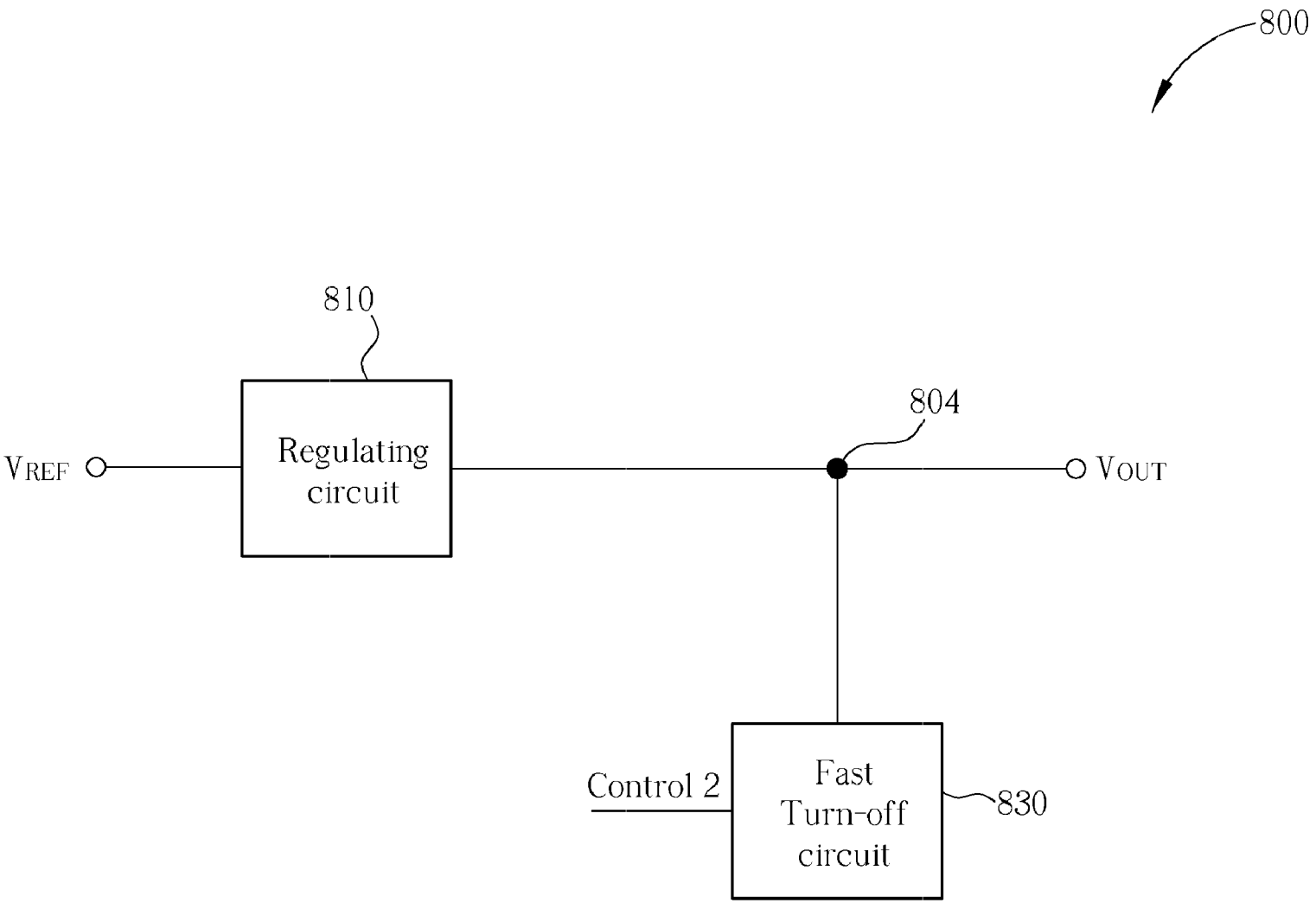
FIG. 8 illustrates an embodiment of an integrated circuit with fast turn off capabilities for providing an output voltage substantially equal to a reference voltage, according to the invention.

FIG. 8 illustrates an embodiment of an integrated circuit 800 having fast turn-off capabilities, for providing an output voltage substantially equal to a reference voltage, according to the invention. The circuit 800 comprises a regulating circuit 810 receiving an input reference voltage $V_{REF}$, and outputting an output voltage $V_{OUT}$ at an output terminal 804. A fast turn-off circuit 830 is coupled to the output terminal 804 and is utilized to quickly draw a discharge current from the output terminal 804 according to a second control signal (Control 2).

Under normal operation, a reference voltage $V_{REF}$ is provided to the regulating circuit 810 from an external source, which indicates a desired voltage level for the output voltage $V_{OUT}$ to maintain. The regulating circuit 810, manages to provide an output voltage $V_{OUT}$ substantially similar to or proportional to the reference voltage $V_{REF}$. Again, the regulating circuit 810 can be a voltage regulator (such as a low drop-out (LDO) regulator similar to that described in FIG. 1).

When the circuit 800 is intended to be shut off, a second control signal (Control 2) is applied to the fast turn-off circuit 830. The fast turn-off circuit 830, in turn, acts to draw a discharge current from the output terminal 804 to immediately prevent any further current from being applied to the arbitrary load device. As described in the related art, in many cases, the regulating circuit 810 may contain a capacitive element incorporated at its output. Also, the arbitrary load coupled to the output terminal 804 may also have a capacitive charge-storing element. In these situations, the fast turn-off circuit 830 would immediately draw current from the output terminal 804 to effectively drain stored current/charge present at the output terminal 804. In this manner, the supply of output current is immediately drawn from the output terminal 804 to prevent unnecessary power draw from the regulating circuit 810 by a load device. Optimal power efficiency is then achieved as the arbitrary load device is prohibited from operation beyond an intended shutoff time of the circuit 800.

As with the previously discussed fast turn off circuit 230 of FIG. 2, the fast turn off circuit 830 of FIG. 8 can also comprise the same embodiments as shown in FIG. 3, with similar composition and functionality. Therefore, further discussion is omitted for brevity.

Figure 9:
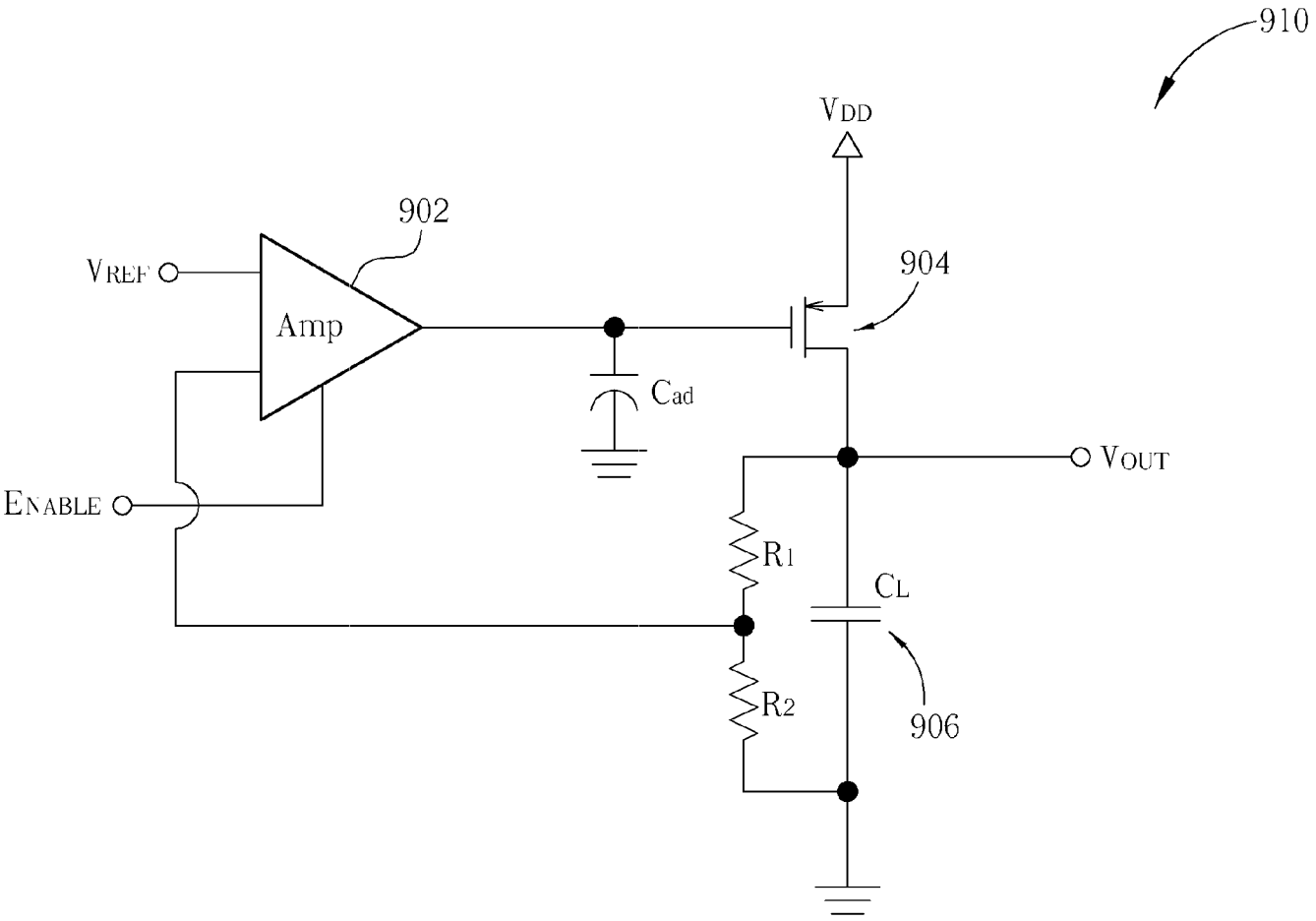
FIG. 9 illustrates an embodiment of a regulating circuit according to the present invention.
Figure 10:
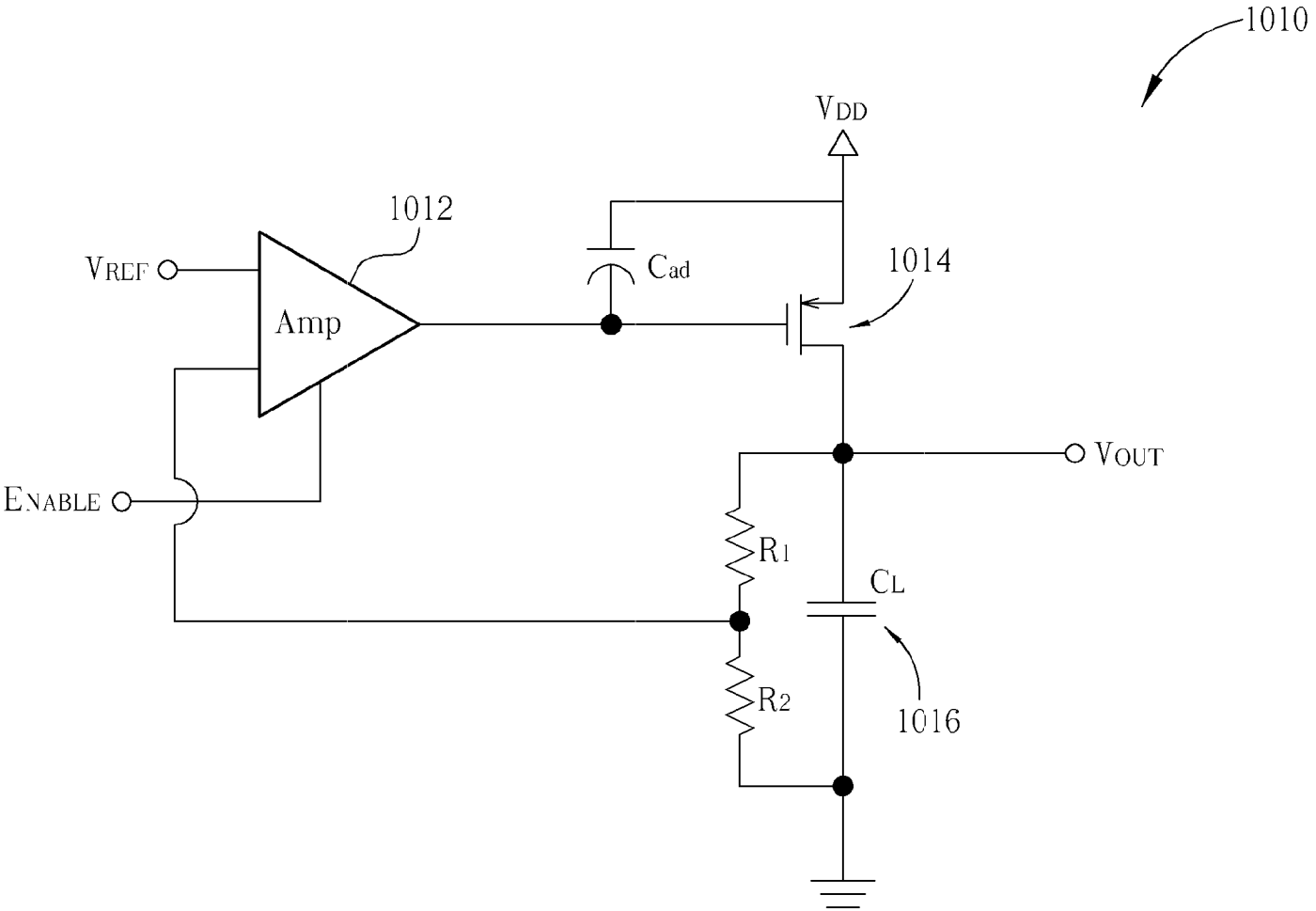
FIG. 10 illustrates another embodiment of a regulating circuit according to the present invention.

As previously eluded to, another desirable characteristic of the present invention is to provide a good PSRR, while reducing noise in the regulating circuit 210. These goals can be accomplished through narrowing the bandwidth of the regulating circuit 210 to reduce output noise, while maintaining acceptable limits for PSRR. This can be accomplished by including a coupling capacitor $C_{ad}$ with the LDO regulator to operate as the regulating circuit 210. FIG. 9 and FIG. 10 illustrate embodiments for the regulating circuit 210 according to the present invention, which manage to reduce noise effects while maintaining a good PSRR.

From FIG. 9, the regulating circuit 210 can be an LDO regulator 910 comprising: an amplifier 902 having a first input terminal coupled to the reference voltage $V_{REF}$; a transistor 904 having a first terminal coupled to an output terminal of the amplifier 902, a second terminal coupled to the output terminal of the regulating circuit 210, and a control terminal coupled to a first supply voltage $V_{DD}$; a first resistor coupling a second terminal of the transistor 904 to a second input terminal of the amplifier 902; a second resistor coupling the second input terminal of the amplifier 902 to a second supply voltage (possibly ground); a load capacitor 906 coupling the second terminal of the transistor 904 to the second supply voltage; and a coupling capacitor $C_{ad}$ coupling the first terminal of the transistor to the second supply voltage.

The addition of the coupling capacitor coupled to the second supply voltage (ground or near ground) in this case, provides for a good PSRR at low frequency use. The following embodiment in FIG. 10, provides another alternative for the regulating circuit, which may provide better results during high frequency usage.

From FIG. 10, the regulating circuit 210 can be an LDO regulator 1010 comprising: an amplifier 1012 having a first input terminal coupled to the reference voltage $V_{REF}$; a transistor 1014 having a first terminal coupled to an output terminal of the amplifier 1012, a second terminal coupled to the output terminal of the regulating circuit 210, and a control terminal coupled to a first supply voltage $V_{DD}$; a first resistor coupling a second terminal of the transistor 1014 to a second input terminal of the amplifier 1012; a second resistor coupling the second input terminal of the amplifier 1012 to a second supply voltage (possibly ground); a load capacitor 1016 coupling the second terminal of the transistor 1014 to the second supply voltage; and a coupling capacitor $C_{ad}$ coupling the first terminal of the transistor to the first supply voltage $V_{DD}$.

The fast turn-off circuit described in the integrated circuit of the invention above allows for an immediate disabling of the driving voltage for more efficient management of energy resources, reducing the potential for wasted energy. Also, the fast turn-on circuit described allows for immediate power to coupled devices, ensuring that steady state voltage conditions are quickly realized. The fast turn-on circuit can include a third control signal for modulating an output current of the voltage reference circuit, helping reduce the effects of a voltage overshoot at the voltage reference circuit output.

The described invention above, therefore not only manages to quickly supply and discharge output current at an output terminal of the voltage regulating device, it also manages to provide a good PSRR while reducing noise constraints.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A circuit for providing an output voltage substantially equal to a reference voltage, the circuit comprising:

a low drop-out (LDO) regulator, coupled to the reference voltage, for producing the output voltage at an output terminal;

a reference current source, having a first end and a second end, for providing a predetermined reference current;

a first transistor, having a first terminal coupled to a first supply voltage, a second terminal, and a control terminal coupled to the second terminal of the first transistor;

a first switch, for selectively coupling the second terminal of the first transistor to the first end of the reference current source according to a first control signal; and a second transistor, having a first terminal coupled to the first supply voltage, a control terminal coupled to the control terminal of the first transistor, and a second terminal directly connected to the output terminal.

2. The circuit of claim 1, wherein when the first switch couples the second terminal of the first transistor to the first end of the reference current source, the second transistor draws a discharge current from the output terminal.

3. The circuit of claim 1, wherein when the first switch couples the second terminal of the first transistor to the first end of the reference current source, the second transistor supplies a charge current to the output terminal.

4. The circuit of claim 1, further comprising:

a second switch, for selectively coupling the second end of the reference current source to a second supply voltage according to a second control signal.

5. The circuit of claim 4, wherein the first control signal is arranged to control the first switch to couple the second terminal of the first transistor to the first end of the reference current source such that the second transistor supplies a charge current to the output terminal, and the second control signal is arranged to control the second switch to couple the second end of the reference current source to the second supply voltage to modulate the predetermined reference current so as to prevent an overshoot condition at the output terminal.

* * * * *